United States Patent [19]

Rice

[11] 4,175,987

[45] Nov. 27, 1979

[54] LOW ALLOY TEMPERED MARTENSITIC STEEL

[75] Inventor: Patrick W. Rice, Dallas, Tex.

[73] Assignee: Otis Engineering Corporation, Dallas, Tex.

[21] Appl. No.: 928,855

[22] Filed: Jul. 28, 1978

Related U.S. Application Data

[63] Continuation of Ser. No. 821,645, Aug. 4, 1977, abandoned.

[51] Int. Cl.[2] ..... C22C 38/22

[52] U.S. Cl. ..... 148/36; 75/126 C

[58] Field of Search ..... 75/124, 125, 126 C, 75/126 E, 128 V, 128 W; 148/36

[56] References Cited

U.S. PATENT DOCUMENTS 3,110,586 11/1963 Gulya ..... 75/125

3,110,635 11/1963 Gulya ..... 148/36

FOREIGN PATENT DOCUMENTS 1373609 3/1962 France ..... 148/36

OTHER PUBLICATIONS

Merriman; "A Dictionary of Metallurgy", 1958, pp. 180, 181.

Stahl Schlussel, 10th Ed., 1974, pp. 98, 99, (steels 39, 40, 77).

*Primary Examiner*—Arthur J. Steiner

*Attorney, Agent, or Firm*—Vinson & Elkins

[57] ABSTRACT

Disclosed is a low alloy, cryogenic steel for hydrogen sulfide service and having improved hardenability. This abstract is neither intended to define the scope of the invention, which, of course, is measured by the claims, nor is it intended to limit the invention in any way.

9 Claims, No Drawings

LOW ALLOY TEMPERED MARTENSITIC STEEL

This is a continuation of application Ser. No. 821,645, filed Aug. 4, 1927, now abandoned.

BACKGROUND OF THE INVENTION

1. Field of the Invention

This invention relates to a low alloy, heat-treatable carbon steel for hydrogen sulfide service and having improved hardenability.

2. The Prior Art

Materials specifications of low alloy steels for arctic service in the petroleum industry impose exacting requirements. In some instances, components made from such steels must be suitable for hydrogen sulfide service. Hydrogen sulfide can embrittle steel components if the components either are not properly heat-treated or if the components are formed of low alloy steels containing more than one percent (1%) nickel. Steel components, for artic service in the petroleum industry, must exhibit a relatively high minimal toughness, as measured by a charpy V-notch test, to withstand expected impulsive loads without failure. Due to the low temperatures often encountered in the arctic, various production equipment purchasers have specified that charpy impact tests be performed on specimens having a temperature of approximately minus 75° F. Generally, the specifications of equipment purchasers specify that a set of three charpy V-notch specimens, when broken at the designated test temperature, show a minimum average impact value of fifteen (15) foot pounds with no single value below either ten (10) or twelve (12) foot pounds.

Using present commercially available low alloy steels, these charpy impact values cannot be reliably obtained at the center of a three-inch thick cross-section. A three-inch thick cross-section would be typical for a flange or other heavy walled part.

For a quenced and tempered low alloy steel, notch toughness depends upon chemical composition and micro-structure. Microstructure in turn depends upon the thickness of the component at the time of heat treatment, the severity of quench (measured by H value) and hardenability (measued by D.I. factor). Presently available low alloy commercial steels do not have a sufficiently high minimum hardenability and the ability to undergo a severe quench. These steels cannot be heat-treated to develop the micro-structure, at the center of a three-inch thick section, which would reliably produce the relatively high specified minimum impact values. For example, although A.I.S.I standard alloy steel 4130 can undergo a rather severe water quench (H=1.5), 4130 steel has too low of a hardenability (nominal D.I. of 4130 steel=2.79") to attain the desired micro-structure at the center of a three-inch section. On the other hand, A.I.S.I. standard alloy steel 4140, which has a higher hardenability (nominal D.I.=4.79), cannot undergo a severe quench. The higher nominal carbon content of 4140 steel and its higher D.I. value increase its susceptibility in cracking. In fact, 4140 steel must be oil quenched, for H=0.5, to avoid cracking. The inability to severely quench 4140 steel prevents the development of the proper micro-structure within the center of a three-inch thick section.

OBJECTS OF THE INVENTION

An object of this invention is to provide a low alloy cryogenic steel for hydrogen sulfide surface and of sufficiently high minimum hardenability so that during heat treatment, a fifty percent (50%) tempered martensite micro-structure can be developed at the center of a thick section to thereby attain good notch toughness at the center of that section.

Another object of this invention is to provide a low alloy cryogenic steel for hydrogen sulfide service which can undergo a severe quench (H=at least approximately 1.5) and have a high minimal hardenability (D.I.=at least approximately 4.80).

Another object of this invention is to provide a low alloy cryogenic steel for hydrogen sulfide service that can be heat-treated to develop a relatively high minimal toughness, as measured by a charpy V-notch impact test, when the charpy sample is obtained from the center of a three-inch thick plate and cooled to a temperature of approximately minus 75° F. for testing.

These and other objects and features of advantage of this invention will be apparent from the detailed description and the appended claims.

BRIEF DESCRIPTION OF THE DRAWINGS

The figures illustrate a test slug of material and indicate the orientation and location at which charpy test specimens are taken.

FIG. 1 shows a top view of the test slug; and

FIG. 2 is a cross-sectional view of the test slug.

DETAILED DESCRIPTION OF THE PREFERRED EMBODIMENT

The foregoing problems are avoided to a large extent, and the above objects are achieved in the present invention by the provision of a new and useful combination of alloying elements. In the normalized, austenitized, quenched, and tempered condition, samples, taken from the center of a thick specimen, will exhibit good notch toughness when an alloy steel is produced with the following compositional range:

| Element | Percent by Weight |
|---|---|
| Carbon | 0.22–0.30 |
| Manganese | 0.85–1.30 |
| Phosphorous | 0.035 max. |
| Sulphur | 0.035 max. |
| Silicon | 0.65 max. |
| Chromium | 0.77–1.13 |
| Molybdenum | 0.33–0.47 |
| Balance Iron and Incidental Steel-making Residual Elements. | |

The total incidental steel-making residual elements should preferably not exceed approximately one percent (1%) by weight. If the composition of each alloying element is near the specified maximum, having not more than approximately one percent (1%) residual elements lessens the likelihood of cracking during quenching. Additionally, the following elements, if present in the composition as residual elements, should not exceed the following ranges:

| Residual Element | Percent by Weight. |
|---|---|
| Copper | 0.50 max. |
| Vanadium | 0.05 max. |

-continued

| Residual Element | Percent by Weight. |
|---|---|
| Nickel | 0.50 max. |

Of course, aluminum may be used during the steel-making process as a deoxidizing agent. It would, therefore, be present as a residual element.

The preferred alloy will be produced with alloying elements having the following compositional ranges:

| Element | Percent by Weight |
|---|---|
| Carbon | 0.24–0.30 |
| Manganese | 0.90–1.25 |
| Phosphorous | 0.020 max. |
| Sulphur | 0.020 max. |
| Silicon | 0.60 max. |
| Chromium | 0.80–1.10 |
| Molybdenum | 0.35–0.45 |
| Balance Iron and Incidental Steel-making Residuals. | |

Preferably the incidental steel-making residuals total not more than one percent (1%) by weight and will contain elements in the following ranges:

| Residual Elements | Percent by Weight |
|---|---|
| Copper | 0.5 max. |
| Vanadium | 0.05 max. |
| Aluminum | 0.03 max. |
| Nickel | 0.50 max. |

To verify the properties of a material having the specified compositional ranges, a three-inch thick by 9.5-inch diameter slug of material was cast, and heat treated. Specimens were prepared from the slug and tested. The composition of the tested material was as follows:

| Element | Percent by Weight |
|---|---|
| Carbon | 0.29 |
| Manganese | 1.01 |
| Phosphorous | 0.018 |
| Sulphur | 0.027 |
| Silicon | 0.31 |
| Chromium | 1.10 |
| Molybdenum | 0.39 |

| Residual Elements | Percent by Weight |
|---|---|
| Copper | 0.21 |
| Nickel | 0.06 |
| Vanadium | 0.01 |
| Balance Iron and Incidental Steel-making Residuals. | |

After casting, the slug of material was subjected to multiple normalizing heat treatments to homogenize the chemical composition on a grain (micro) structure scale.

The normalized material was austenitized, water quenched (H=1.5) and tempered.

The test slug 10 is illustrated in FIGS. 1 and 2. The test slug 10 had a diameter (D) of nine and a half inches (9.5") and a thickness (T) of three inches (3.00"). A one-inch (1") hole 12 was drilled through the center to reduce the possibility of cracking during heat treatment.

The orientation of the test specimens 14 can be seen in FIG. 1. The V-notch 16 of each test specimen 14 is located a distance D/4 from the center of the test slug 10. The location of the surface test specimens 14*a* and subsurface test specimens 14*b* can be seen in FIG. 2. The impact test specimens 14 were standard, full-sized charpy specimens and had a cross-section of ten millimeters by ten millimeters (10mm×10mm) except at the location of the V-notch 16.

Test specimens were cooled to minus 75° F. and held in a bath at that temperature a minimum of ten (10 minutes) before breaking the first specimen. The time between the removal of the test specimens from the bath and breakage in a charpy machine was no longer than five (5) seconds.

Test results are as follows:

| Surface Test Specimens | | | |
|---|---|---|---|
| Specimen Number | Impact/ Foot Pounds | Percent Shear | Lateral Expansion |
| 1 | 27.0 ft. lb. | 37% | 0.012 in. per side |
| 2 | 25.0 ft. lb. | 35% | 0.011 in. per side |
| 3 | 19.0 ft. lb. | 28% | 0.008 in. per side |
| Average | 23.6 ft. lb. | | |

| Subsurface Test Specimens | | | |
|---|---|---|---|
| Specimen Number | Impact/ Foot Pounds | Percent Shear | Lateral Expansion |
| 1 | 26.0 ft. lb. | 32% | 0.011 in. per side |
| 2 | 26.0 ft. lb. | 50% | 0.012 in. per side |
| 3 | 23.0 ft. lb. | 39% | 0.010 in. per side |
| Average | 25.0 ft. lb. | | |

The above data thus demonstrates that the low alloy steel of the present invention develops high notch toughness in the center of a relatively thick section of material. Such a low alloy steel would be well adapted for hydrogen sulfide service and cryogenic service of the arctic petroleum fields.

Specimens from a slug of material that was not subjected to multiple normalizing heat treatments were also tested. The slug of material was austentized, water quenched and tempered. The specimens were prepared and tested in the same manner as above described. However, high notch toughness was not obtained. It is believed that the chemical composition of the slug of material was not sufficiently homogenized on a grain structure level. Subjecting components formed of a steel consisting of the elements specified within the ranges specified for each to multiple normalizing heat treatments will homogenize the claimed composition.

Throughout the specification and in the claims, percentages are by weight. The specific embodiments are intended to be illustrative and not limiting. The foregoing disclosure is illustrative and explanatory thereof. Various changes, modifications and variations, may be made, such as would occur to one skilled in the art to which the invention relates, within the scope of the appended claims without departing from the spirit of the invention.

What is claimed is:

1. An improved hydrogen sulfide service, cryogenic steel consisting of:

| Element | Percent by Weight |
|---|---|
| Carbon | 0.22–0.30 |
| Manganese | 0.85–1.30 |
| Phosphorous | 0.035 max. |
| Sulphur | 0.035 max. |
| Silicon | 0.65 max. |
| Chromium | 0.77–1.13 |
| Molybdenum | 0.33–0.47 |

Balance Iron and not more than approximately 1% incidental steel-making residual elements, said steel having been heat treated and water quenched (H=at least approximately 1.5) to develop a 50% tempered martensite micro-structure at the center of the thickest section thereof.

2. The steel of claim 1 wherein said incidental steel-making residual elements consist of:

| Element | Percent by Weight |
|---|---|
| Copper | 0.50 max. |
| Vanadium | 0.05 max. |
| Nickel | 0.50 max. |

3. The steel of claim 1 wherein said incidental steel-making residual elements consist of:

| Element | Percent by Weight |
|---|---|
| Copper | 0.50 max. |
| Vanadium | 0.05 max. |
| Nickel | 0.50 max. |
| Aluminum | 0.03 max. |

4. An improved hydrogen sulfide service, cryogenic steel consisting of:

| Element | Percent by Weight |
|---|---|
| Carbon | 0.24–0.30 |
| Manganese | 0.90–1.25 |
| Phosphorous | 0.020 max. |
| Sulphur | 0.020 max. |
| Silicon | 0.60 max. |
| Chromium | 0.80–1.10 |
| Molybdenum | 0.35–0.45 |

Balance Iron and not more than 1% incidental steel-making residual elements and having been treated to have at least about a fifth percent (50%) tempered martensite micro-structure at the center of the thickest section thereof, and having a high minimal hardenability (D. I. = least approximately 4.80).

5. The steel of claim 4 wherein said incidental steel-making residual elements consist of:

| Elements | Percent by Weight |
|---|---|
| Copper | 0.50 max. |
| Vanadium | 0.05 max. |
| Nickel | 0.50 max. |

6. The steel of claim 4 wherein the incidental steel-making residual elements consist of:

| Element | Percent by Weight |
|---|---|
| Copper | 0.50 max. |
| Vanadium | 0.05 max. |
| Nickel | 0.50 max. |
| Aluminum | 0.03 max. |

7. An improved hydrogen sulfide service, cryogenic steel consisting of:

| Element | Percent by Weight |
|---|---|
| Carbon | 0.22–0.30 |
| Manganese | 0.85–1.30 |
| Phosphorous | 0.035 max. |
| Sulphur | 0.035 max. |
| Silicon | 0.65 max. |
| Chromium | 0.77–1.13 |
| Molybdenum | 0.33–0.47 |

Balance Iron and not more than approximately 1% incidental steel-making residual elements, and having been treated to have at least about a fifty percent (50%) tempered martensite micro-structure at the center of the thickest section thereof, and having a high minimal hardenability (D. I. = at least approximately 4.80).

8. The steel of claim 7 wherein said incidental steel-making residual elements consist of:

| Element | Percent by Weight |
|---|---|
| Copper | 0.50 max. |
| Vanadium | 0.05 max. |
| Nickel | 0.50 max. |

9. The steel of claim 7 wherein said incidental steel-making residual elements consist of:

| Element | Percent by Weight |
|---|---|
| Copper | 0.50 max. |
| Vanadium | 0.05 max. |
| Nickel | 0.50 max. |
| Aluminum | 0.03 max. |

* * * * *

UNITED STATES PATENT AND TRADEMARK OFFICE

CERTIFICATE OF CORRECTION

PATENT NO. : 4,175,987

DATED : November 27, 1979

INVENTOR(S) : Patrick W. Rice

It is certified that error appears in the above-identified patent and that said Letters Patent is hereby corrected as shown below:

On the title page;

"No Drawings" should read --2 Drawings Figures--

Figs. 1 and 2 should be added as per attached page.

Signed and Sealed this

*Sixth* Day of *August 1985*

[SEAL]

*Attest:*

DONALD J. QUIGG

*Attesting Officer*

*Acting Commissioner of Patents and Trademarks* fig. 1
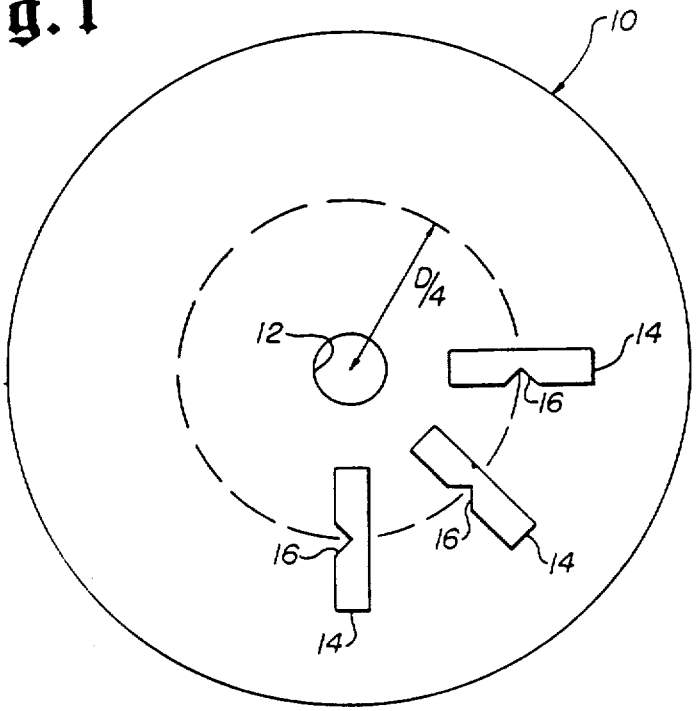
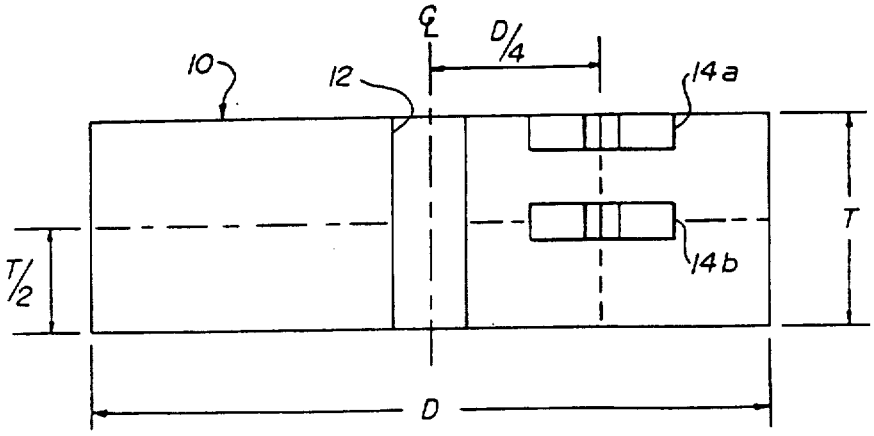
fig. 2